United States Patent [19]

Holohan, Jr.

[11] Patent Number: 4,936,818

[45] Date of Patent: Jun. 26, 1990

[54] PAPER SCORING DEVICE

[76] Inventor: Joseph Holohan, Jr., 350 North Delsea Dr., Clayton, N.J. 08312

[21] Appl. No.: 329,322

[22] Filed: Mar. 27, 1989

[51] Int. Cl.[5] ..... B31B 1/25

[52] U.S. Cl. ..... 493/396; 493/403; 493/471; 493/473; 83/659

[58] Field of Search ..... 493/370, 396, 402, 403, 493/471, 473; 83/675, 676, 698

[56] References Cited

U.S. PATENT DOCUMENTS

| | | | |
|---|---|---|---|
| 1,828,234 | 10/1931 | Swift | 493/403 |
| 2,446,594 | 8/1948 | Johansson | 493/403 |
| 3,318,206 | 5/1967 | Kuehn et al. | 493/403 |
| 3,363,496 | 1/1968 | Sauer | 83/659 |
| 4,023,790 | 5/1977 | Gortowski | 493/403 |
| 4,141,544 | 2/1979 | Birkenmayer | 493/403 |
| 4,795,414 | 1/1989 | Blumle | 493/403 |

OTHER PUBLICATIONS

Maschinenbau Oppenweiler Specification for Folding, Scoring and Cutting Apparatus.

*Primary Examiner*—William E. Terrell
*Attorney, Agent, or Firm*—Thomas A. Lennox

[57] ABSTRACT

A paper scoring device is on a first rotatable shaft of a pair of rotatable parallel shafts with a cylindrical member on the second shaft with a circular scoring slot around the cylindrical member where the paper is fed between the rotatable shafts. A male scoring device has a cylindrical base member with a shoulder and a cylindrical sleeve threaded onto the base member forming an outwardly open cylindrical groove in which a cylindrical ring member fits and rotates freely. The cylindrical ring is a pair of plastic rings sandwiching a metal ring which extends outwardly past the surface of the plastic rings to form a scoring rib which interfits into the slot to score the paper.

7 Claims, 3 Drawing Sheets

PAPER SCORING DEVICE

BACKGROUND OF THE INVENTION

This invention involves automatic paper folding apparatus and more specifically an improvement device and method for the scoring of paper, prior to the folding operation.

Once a brochure is printed, it is usually necessary to fold the brochure at least in half and generally in thirds, quarter or whatever is designed. Mechanized automatic folding machines have been constructed and are available commercially. These machines utilize variable sheet gap control and stepless speed regulators to achieve optimum production. Buckle folding is accomplished by feeding a sheet between a series of rollers and specifically to a buckle mounth at a slight angle against a stop. Guide bars prevent the sheet from moving up or down and the sheet has only one possibility of getting out a designated area requiring it to buckle toward folding rollers which, as they rotate in an opposite direction draw it between the rollers. This action forms the fold. Before entering a buckle folding apparatus, for many types of paper stack, particularly the coated papers, it is necessary to score the paper so that it will buckle along a chosen line in a neat uncracked fashion. This scoring or creasing is a standard and required step in any buckle folding apparatus for many papers. Combination folds can be made and the rate of production in sheets per hour is dependent upon the running speed of the device. The running speed typically varies from about 45 to 150 meters per minute according to the paper stability. Taking into account the space between separate sheets, that being the distance between the rear edge and the leading edge of the following sheet, it is possible to run about 10,000 to 20,000 sheets per hour, depending upon the size of the sheet.

The term "scoring" is the common term used to describe placing an indent in the paper to facilitate and essentially assure folding along the proper line. However, the term "creasing" is somtime used for this operation, although that generally refers to an operation after the scoring has been completed. Typically, creasing devices are mounted on a pair of rotating parallel shafts, that are rotating in opposite directions with the paper drawn between the shafts from the side where the shafts are rotating toward each other. On one of the shafts is mounted a cylindrical member with a slot into the surface of the member in a circular shape around the cylinder. This scoring slot receives a male scoring member in the shape of a ring extending outwardly from a second cylindrical member mounted on the other rotating shaft such that the scoring member is aligned with the scoring slot. When the paper is pulled between the two rotating shafts, the paper is scored between the scoring member and the scoring slot. The scoring member is essentially an upraised rib formed as an integral part of the cylindrical member. Most importantly, both of the cylindrical members, one having the scoring slot and one having the scoring member, are both detachably, but firmly fixed to the rotating shafts so that each rotate at the same speed of the rotating shafts.

Different types of papers present different problems than the scoring operation. For some papers, the scoring apparatus tends to nick the edges of the paper as it initially grabs the paper between the scoring member and the scoring slot. Also with certain types of paper, a poor quality fold is obtained. This is particularly true of coated papers wherein the coating sometimes tends to crack during the folding operation unless a separate die press scoring device is used. For those paper, a separate operation on a separate machine greatly reduces the rate of processing. It is most desirable to be able to score and fold in the same machine. But that is not possible with some types of papers in the present equipment. The prior art devices do not satisfy these problems nor attain the objects described herein below.

SUMMARY OF THE INVENTION

An object of the present invention is to provide a paper scoring device which will score a wide variety of papers greatly increasing the versatility of paper scoring apparatuses.

It is a particular object of the present invention to provide a scoring device that will score plastic coated papers without causing the paper to crack in the coating when the paper is folded.

It is an object of the present invention to provide a paper scoring device that resist nicking the edges of paper being fed into the scoring device. It is a further object of the present invention to provide a paper scoring device that can be run at high speeds and yet provide high quality scoring of the papaer prior to folding.

It is a specific object of the present invention to provide a scoring device that is particularly effective on coated stock and heavier paper providing a quality good looking job.

The invention is a paper scoring devicce on a first rotatable shaft of a pair of rotatable parallel shafts, rotatable in opposite directions with a cylindrical member fixed on a second rotatable shaft, having a scoring slot means on the cylindrical member to interfit with the scoring device to score the paper. A paper feed means to feed the paper between the rotatable shafts entering from the side where the shafts are rotating toward the paper is present. The scoring device includes a cylindrical base member, having a length, first and second ends, an outside surface, and in inside surface that abuts the first rotatable shaft. The device further includes an integral shoulder on the first end of the base member having a verticl face facing inwardly from the first end over the outside surface of the base member. The device also includes attachment means to detachably fix the base member to the first rotatable shaft. The device further includes a cylindrical sleeve member interfitable around and over the second end of the base member, and a second atachment means to detachable attach the sleeve member to the base member. The width of the sleeve member and the positioning of the sleeve member along the length of the base member leaves a cylindrical groove bounded by an inside vertical face of the sleeve member, the vertical face of the shoulder, and the outside surface of the base member. The device further includes a cylindricl ring member slideably fitted in and freely rotating in the cylindrical groove. The ring member includes a plastic ring structure comprising a pair of polymeric plastic rings having equal radial thickness, a metal ring sandwiched between the plastic rings and having an outside diameter greater than outside diameters of the plastic rings, wherein the outside diameter of the metal ring is sufficient to meet the scoring slot means, and a horizontal thickness of the metal ring is sufficient to score the paper as it is fed between the metal ring and the scoring slot means. Lastly the device also includes third attachment means to attach the metal ring and the plastic ring structure into the integral ring member.

It is preferred that the second attachment means include threads around the base member on a portion of the outside surface proximate the second end of the base member onto which threads on an inside surface of the sleeve member engage. It is also preferred that the metal ring be hardened steel. It is further preferred that the plastic rings be engineering polymeric plastic. It is also preferred that inside diameter of the metal ring be larger than the inside diameters of the plastic rings. It is further preferred that the plastic ring structure be the two plastic rings with the third attachment means including two bolts passing through one plastic ring and the metal ring, and threadably engaging the other plastic ring.

A preferred paper scoring device is installable on a first rotatable shaft of a pair of rotatable parallel shafts, rotatable in opposite directions with a cylindrical member fixed on a second rotatable shaft, having a scoring slot means on the cylindrical member to interfit with the scoring device to score the paper. The preferred scoring device also includes a cylindrical base member and an integral shoulder as above. The preferred device includes threads around the base member on a portion of the outside surface proximate the second end of the base member, and a cylindrical sleeve member threadably engaged to the threads of the base member. The width of the sleeve member and the positioning of the threads leaves a cylindrical groove bounded by an inside vertical face of the sleeve member, the vertical face of the shoulder, and the outside surface of the base member. The cylindrical ring member includes a pair of polymeric plastic rings having equal radial thickness, a metal ring sandwiches between the plastic rings and having an outside diameter greater than outside diameters of the plastic rings wherein the outside diameter of the metal ring is sufficient to meet the scoring slot means, and a horizontal thickness of the metal ring is sufficient to score the paper as it is fed between the metal ring and the scoring slot means, and third attachment means to attach the metal ring and the plastic ring structure into the integral ring member.

The invention is also a method of scoring paper including providing a pair of rotating parallel shafts, rotating in opposite directions and fixing a cylindrical member on a second of the rotating shafts, the cylindrical member having a scoring slot means around the cylindrical member to interfit with a scoring device to score the paper. The method further includes providing the scoring device that includes a cylindrical base member, having a length, first and second ends, an outside surface, and an inside surface that abuts the first rotatable shaft. The scoring device further includes an integral shoulder on the first end of the base member having a vertical face facing inwardly from the first end over the outside surface of the base member. The scoring device also includes a cylindrical sleeve member interfitable around and over the second end of the base member. The scoring device further includes a cylindrical ring member that includes a plastic ring structure comprising a pair of polymeric plastic rings having equal radial thickness, and a metal ring sandwiched between the plastic rings and having an outside diameter than outside diameters of the plastic rings. The method further includes attaching the metal ring and the plastic ring structure into the integral ring member. The method also includes sliding the cylindrical ring member over the base member to abut the vertical face of the shoulder and detachably attaching the sleeve member to the base member, leaving a cylindrical groove bounded by an inside vertical face of the sleeve member, the vertical face of the shoulder, and the outside surface of the base member, the groove being of sufficient size to allow the ring member to slideably fit in and freely rotate in the cylindrical groove. The method also includes detachably fixing the base member to the first rotatable shaft, and feeding the paper between the rotatable shafts entering from the side where the shafts are rotating toward the paper between the scoring means and the scoring slot means. The outside diameter of the metal ring is sufficient to meet the scoring groove means, and a horizontal thickness of the metal ring is sufficient to score paper as it is fed between the metal ring and the scoring slot means.

DESCRIPTION OF PREFERRED EMBODIMENTS

Figure 1:
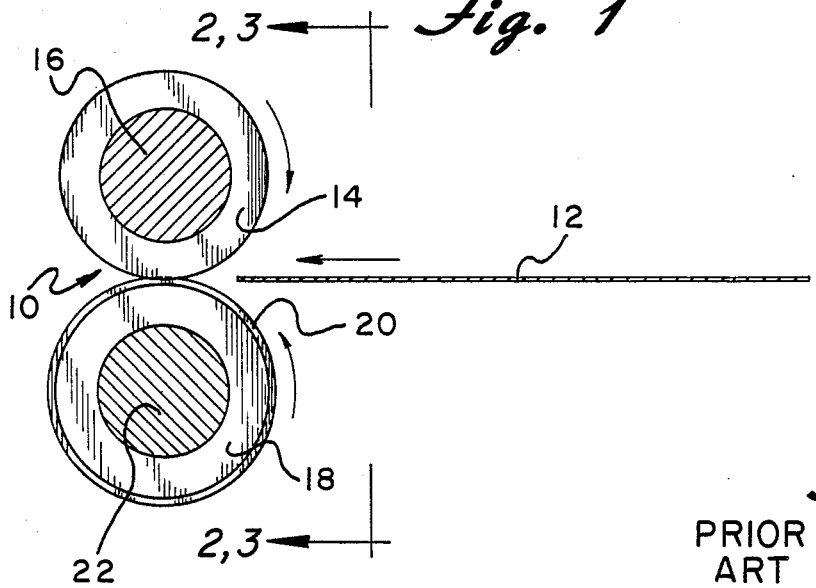
FIG. 1 is a diagram illustrating the feeding of paper between a scoring device.
Figure 2:
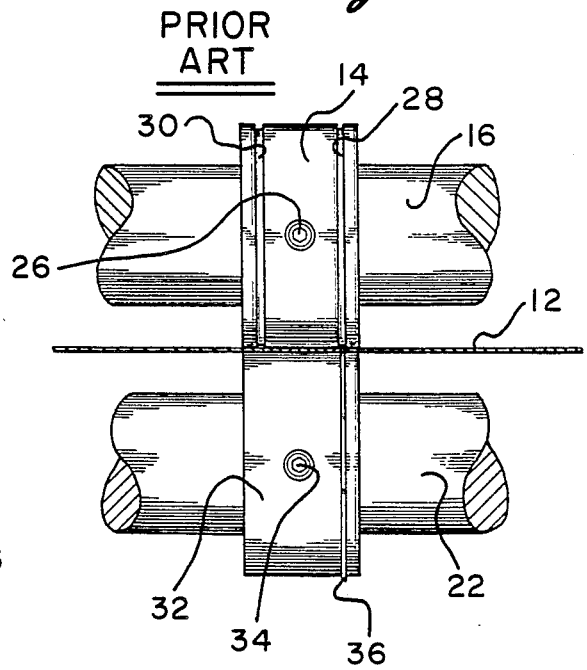
FIG. 2 is a cut-away elevational view of a prior art creasing device.

The diagram in FIG. 1 illustrates the general configuration of a scoring or creasing device 10 which receives paper 12 between shafts 16 and 22 rotating in opposite directions. Shafts 16 and 22 rotate in opposite directions and paper 12 is fed between them from the side that they rotate towards each other and to the paper. The scoring slot device 14 is a cylindrical member fixed on shaft 16 to rotate at the speed the shaft turns. The male scoring device includes cylindrical member 18 with circular upraised male scoring rib 20. Depending upon whether FIG. 1 is illustrating the prior art as illustrated in FIG. 2 or a device of the present invention illustrated in the latter figures, the male scoring rib 20 is either fixed to cylindrical member 18 to rotate at the same speed as shaft 22, or as in the present invention, to rotate freely. In FIG. 2, the prior art scoring device is illustrated with scoring slot device 14 securely fixed on shaft 16 with allen set screw 26. Scoring slot device 14 is a cylindrical steel member. Circular slots 28 and 30 are cut into the outside surfacea bout ⅛ inch from each end and range from about 1/32 to about 3/32 inch wide and about 1/64 inch deep. The prior art male scoring device includes cylindrical base member 32 which is securely fixed to rotating shaft 22 by allen set screw 34. Upraised hardened steel rib 34 is an integral part of cylindrical base 32 and is positioned circularly completely around base member 32. Male scoring rib 34 is typically about 1/64 inch high and about 1/32 inch wide. As paper 12 is drawn between this scoring device, a score of the paper is produced between rib 36 and slot 28. When slot 28 becomes worn, device 14 may be flip-flopped so that slot 30 is in alignment with scoring rib 36.

Figure 3:
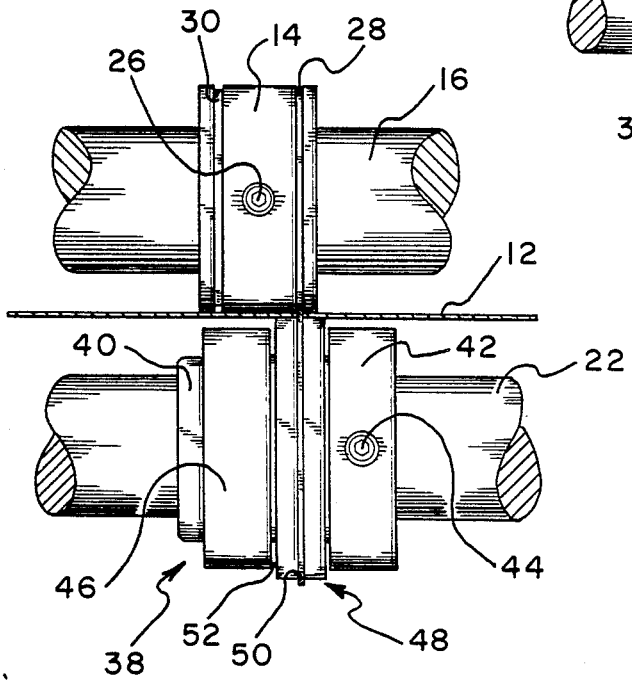
FIG. 3 is an elevational view of a scoring device of the present invention.
Figure 4:
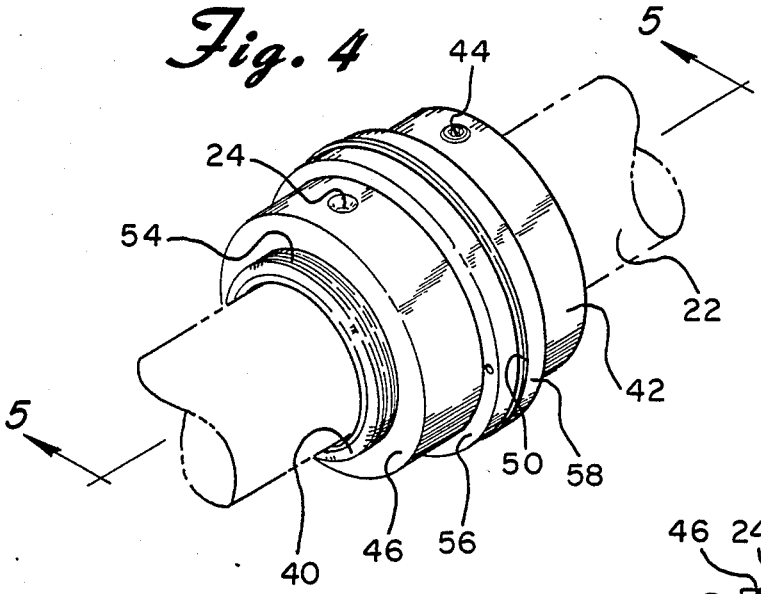
FIG. 4 is a perspective view of the scoring device illustrative in FIG. 3.
Figure 5:
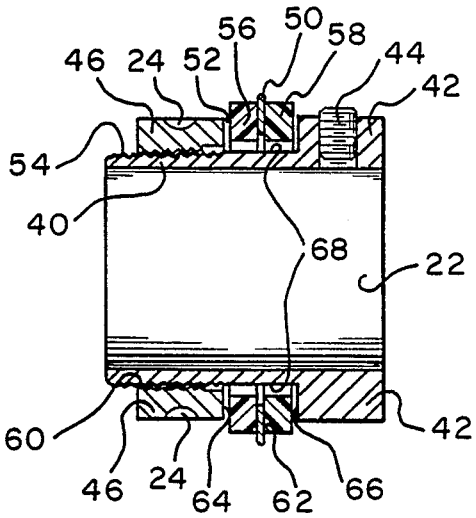
FIG. 5 is a cross-sectional view taken along lines 5—5 of FIG. 4.
Figure 6:
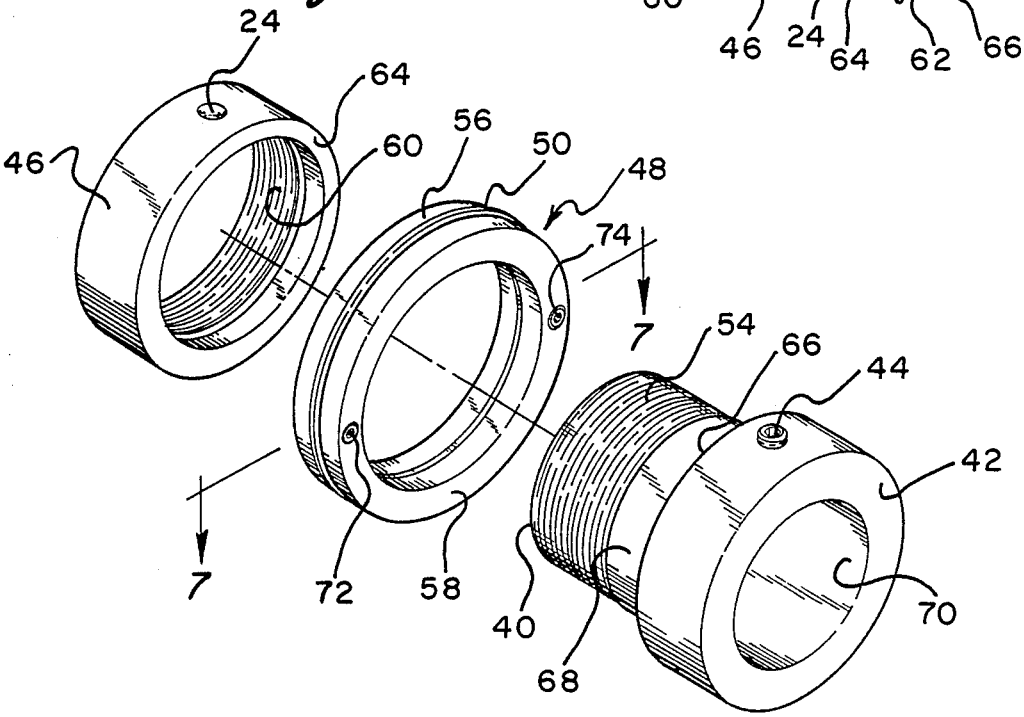
FIG. 6 is an exploded perspective view of the scoring device illustrated in FIG. 4.
Figure 7:
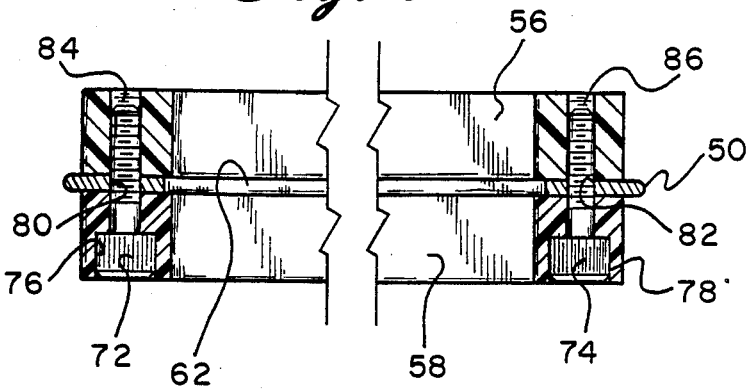
FIG. 7 is a cross-sectional view taken lines 7—7 of FIG. 6.
Figure 8:
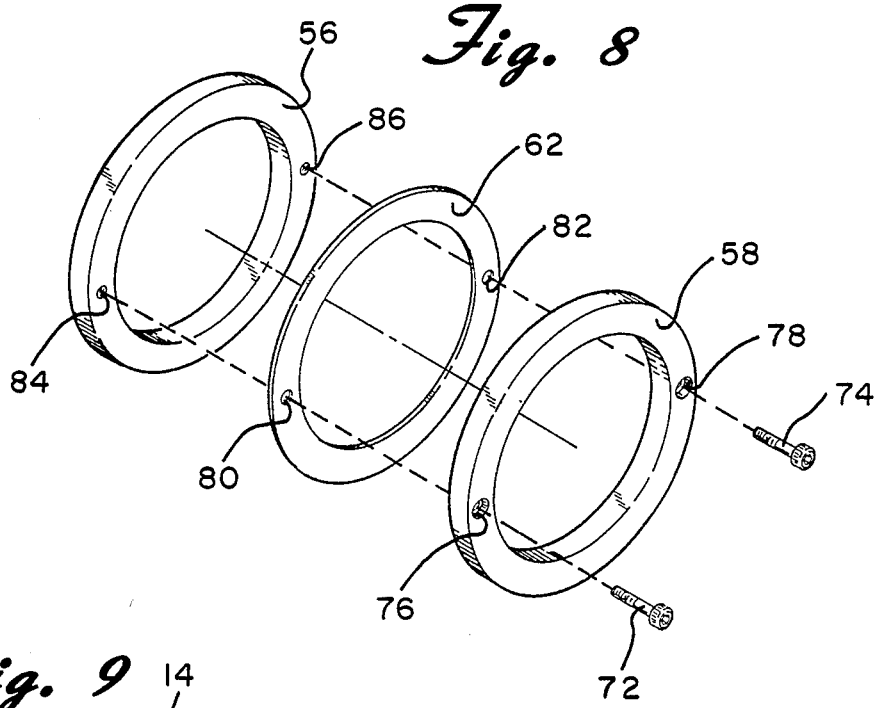
FIG. 8 is an exploded view of the ring member assembly illustrated in FIG. 6.
Figure 9:
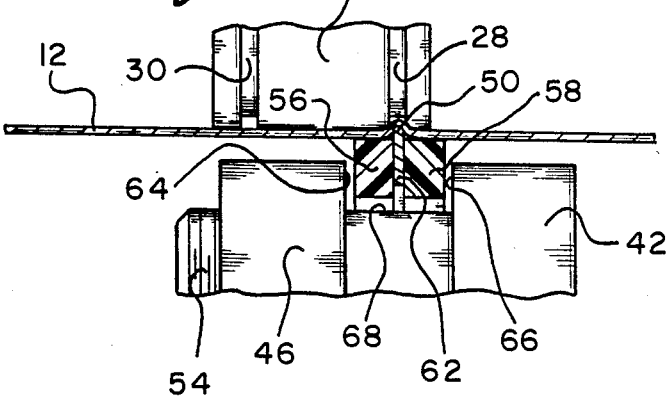
FIG. 9 is a partial cut-away, cross-sectional view taken along lines 9—9 of FIG. 6.

In FIG. 3, the scoring slot device 14 on shaft 16 is unchanged but male scoring device 38 of the present invention is fixed on shaft 22. Device 38 includes base cylindrical member 40 on which has upraised shoulder section 42, as an integral part of base 40. The base member is about 1 ¾ inch long with an outside diameter of about 1 ½ inches shoulder 42 has a diameter of about 2 ½ inches. Base member 40 is being securley fixed to shaft 22 by allen set screw 44. Cylindrical ring member assembly 48 with upraised male scoring rib 50 spins freely in groove 52, further described below. As further illustrated in FIGS. 4, 5 and 6, cylindrical sleeve member 46, which is about ½ inch long and about 2 inches in outside diameter is threadably engaged to threads 54 on the outside surface of base member 40. Holes 24 spaced around sleeve 46 allow a wrench to tighten or loosen the sleeve. Cylindrical ring member 48 is constructed of support rings 56 and 58 which sandwich washer shaped hardened steel ring 62 which protrudes past the outside surfaces of rings 56 and 58 to provide male scoring rib 50. Groove 52 is bounded by vertical surface 64 on the inside of sleeve member 46, vertical surface 66 which is the inside surface of shoulder 42 and outside surface 68 of base member 40. Cylindrical ring member 48 spins freely in that groove 52. Interior threads 60 on the inside surface of sleeve member 46 engage threads 54 on the outside surface of base member 40. The width of sleeve 46 and the positioning of threads 54 and 60 allow the sleeve to be threadably engaged and tightened all the way to a stop leaving groove 52 open and of a fixed width of about 15/64 inch. Cylindrical ring member 48 is about 14/64 inch wide constructed of plastic support rings 56 and 58 sandwiching metal ring 50, generally in the shape of a metal washer. The ring members are held together by bolts 72 and 74 illustrated in the cross-sectional cut away view of FIG. 7 and the exploded view of FIG. 7 and the exploded view of FIG. 8. Bolts 72 and 78 engage through holes 76 and 78 in ring 58, through holes 80 and 82 in ring 62 and threadable engage threaded holes 84 and 86 in ring 56 firmly holding the three parts together sandwiching ring 62 between. The inside diameter of ring 62 is larger than that of the plastic rings the rings is such that the engineering plastic material of support rings 56 and 58 only rotate and slide on surface 68. Plastic rings 56 and 58 are molded of DELRIN® engineering plastic althrough other low friction engineering plastic compositions may be employed including fluorocarbon polymers, including but not limited to polytetrafluoroethytlene, fluorinated ethylene propylene, ethylene tetrafluoroethylene, polyvinylidene fluoride, perfluoroalkoxy ethylene and ethylene-chlorotrifluro ethylene, polyoxymethylene homopolymer (DELRIN), polybutadiene terephthalate, polyphetnylene sulfide, polycarbonate, polyethyletherketone, polyethersulfone, polysulfone, polyethylene terephthalate, polyetherimide, liquid crystal polymers, high density and ultra high molecular weight polyethylene, polypropytlene, super tough nylon and acetal polymers, ionomer polymers and like polymers. Ring 62 is constructed of hardened steel about 1/64 inch thick with an outside diameter of 2 19/64 inches and an inside diameter of 1 37/64 inches. Each support ring 56 and 58 is an outside diameter of 2 ¼ inches and an inside diameter of ½ inches. The combined width of cylindrical ring member 48, is preferably about 0.436 inches with not positive tolerance and with a negative one mil tolerance. In FIG. 9, a diagram, not necessarily to scale is provided in an expanded size view to illustrate the relationship and engagement of ring member 48 to score paper 12 against slot 28 and scoring slot device 14.

While this invention has been described with reference to the specific embodiments disclosed herein, it is not confined to the details set forth and the patent is intended to include modifications and changes which may come within and extend from the following claims.

I claim:

1. A paper scoring device on a first rotatable shaft of a pair of rotatable parallel shafts, rotatable in opposite directions with a cylindrical member fixed on a second rotatable shaft, having a scoring slot means on the cylindrical member to interfit with the scoring device to score the paper, and a paper feed means to feed the paper between the rotatable shafts entering from the side where the shafts are rotating toward the paper, the scoring device comprising:

(a) a cylindrical base member, having a length, first and second ends, an outside surface, and an inside surface that abuts the first rotatable shaft, (b) an integral shoulder on the first end of the base member having a vertical face facing inwardly from the first end over the outside surface of the base member, (c) first atachment means to detachably fix the base member to the first rotatable shaft, (d) a cylindrical sleeve member interfitable around and over the second end of the base member, (e) second attachment means to detachably attach the sleeve member to the base member, wherein the width of the sleeve member and the positioning of the sleeve member along the length of the base member leaves a cylindrical groove bounded by an inside vertical face of the sleeve member, the vertical face of the shoulder, and the outside surface of the base member, and (f) a cylindrical ring member slideably fitted in and freely rotating in the cylindrical groove, the ring member comprising:

(i) a plastic ring structure comprising a pair of polymeric plastic rings having equal radial thickness, (ii) a metal ring sandwiched between the plastic rings and having a outside diameter greater than outside diameters of the plastic rings wherein the outside diameter of the metal ring is sufficient to meet the scoring groove means, and a horizontal thickness of the metal ring is sufficient to score paper as it is fed between the metal ring and the scoring slot means, and (iii) third attachment means to attach the metal ring and the plastic ring structure into the integral ring member.

2. The device of claim 1 wherein the second attachment means comprises threads around the base member on a portion of the outside surface proximate the second end of the base member onto which threads on an inside surface of the sleeve member engage.

3. The device of claim 1 wherein the metal ring is hardened steel.

4. The device of claim 1 wherein the plastic rings are engineering polymeric plastic.

5. The device of claim 1 wherein an inside diameter of the metal ring is larger than the inside diameters of the plastic rings.

6. The device of claim 1 wherein the plastic ring structure is the two plastic rings with the third attachment means comprising two bolts passing through one plastic ring and the metal ring, and threadably engaging the other plastic ring.

7. A paper scoring device on a first rotatable shaft of a pair of rotatable parallel shafts, rotatable in opposite directions with a cylindrical member fixed on a second rotatable shaft, having a scoring slot means on the cylindrical member to interfit with the scoring device to the score the paper, and a paper feed means to feed the paper between the rotatable shafts entering from the side where the shafts are rotating toward the paper, the scoring device comprising:

(a) a cylindrical base member, having first and second ends, an outside surface, and an inside surface that abuts the first rotatable shaft, (b) an integral shoulder on the first end of the base member having a vertical face facing inwardly from the first end over the outside surface of the base member, (c) threads around the base member on a portion of the outside surface proximate the second end of the base member, (d) first attachment means to detachably fix the base member to the first rotatable shaft, (e) a cylindrical sleeve member threadably engaged to the threads of the base member, wherein the width of the sleeve member and the positioning of the threads leaves a cylindrical groove bounded by an inside vertical face of the sleeve member, the vertical face of the shoulder, and the outside surface of the base member, and (f) a cylindrical ring member slideably fitted in and freely rotating in the cylindrical groove, the ring member comprising:

(i) a pair of polymeric plastic rings having equal radial thickness, and (ii) a metal ring sandwiched between the plastic rings and having a outside diameter greater than outside diameters of the plastic rings wherein the outside diameter of the metal ring is sufficient to meet the scoring slot means, and a horizontal thickness of the metal ring is sufficient to score paper as it is fed between the metal ring and the scoring slot means, and (iii) second attachment means to attach the metal ring and the plastic ring structure into the integral ring member.

* * * * *